US008684207B2

(12) United States Patent
Deslias

(10) Patent No.: US 8,684,207 B2
(45) Date of Patent: Apr. 1, 2014

(54) ADVANCED STOPPER HEAD

(75) Inventor: Olivier Deslias, Bourg Charente (FR)

(73) Assignee: Les Bouchages DELAGE, Gensac la Pallue (FR)

( * ) Notice: Subject to any disclaimer, the term of this patent is extended or adjusted under 35 U.S.C. 154(b) by 20 days.

(21) Appl. No.: 13/332,929

(22) Filed: Dec. 21, 2011

(65) Prior Publication Data

US 2012/0160799 A1 Jun. 28, 2012

(30) Foreign Application Priority Data

Dec. 23, 2010 (FR) ..... 10 61134

(51) Int. Cl.
*B65D 39/00* (2006.01)
*B65D 39/16* (2006.01)

(52) U.S. Cl.
USPC ..... 215/364; 215/355

(58) Field of Classification Search
USPC ..... 215/294, 355, 364, 296, 299, 300
See application file for complete search history.

(56) References Cited

U.S. PATENT DOCUMENTS 2,095,272 A * 10/1937 Vanderhoof ..... 215/296
2,130,081 A 9/1938 Fay
6,769,560 B1 * 8/2004 Lin ..... 215/361
2003/0196985 A1 10/2003 Wheeler
2004/0112856 A1 * 6/2004 Hwang et al. ..... 215/361
2006/0231520 A1 * 10/2006 Van Cromvoirt ..... 215/355
2007/0272650 A1 * 11/2007 Kishi et al. ..... 215/364
2008/0035599 A1 2/2008 Seibel
2008/0116165 A1 * 5/2008 Lin ..... 215/294
2011/0017698 A1 * 1/2011 Escobar et al. ..... 215/355
2011/0036805 A1 2/2011 Escobar et al.
2011/0127231 A1 * 6/2011 Waugh ..... 215/294

FOREIGN PATENT DOCUMENTS

DE 102004034709 B3 9/2006

OTHER PUBLICATIONS

French Search Report, dated Mar. 21, 2011, from corresponding application FR 1061134.

* cited by examiner

*Primary Examiner* — Mickey Yu
*Assistant Examiner* — Niki Eloshway
(74) *Attorney, Agent, or Firm* — Young & Thompson

(57) ABSTRACT

A stopper head (1) to be secured to a stopper body (2) to form a stopper for a container, includes a base (3) on which a lug (4) is positioned such that it protrudes, the lug (4) being designed to cooperate with the body during the assembly of the body and the lug (4), the lug (4) including at least one recess (5) opening laterally, at both of its ends, such that the lug (4) is crossed through to anchor the body with the head (1).

19 Claims, 2 Drawing Sheets

ADVANCED STOPPER HEAD

BACKGROUND OF THE INVENTION

1. Field of the Invention

This invention relates to a stopper head. It also relates to a stopper for a container, like what is used to seal a bottle.

2. Description of the Related Art

There are stoppers that comprise a cylindrical portion made of cork or a synthetic material, also called a stopper body, one end of which is secured to a plastic head by gluing.

These stoppers for the food industry must meet very strict standards.

However, the use of glues that are suitable for contact with food cannot guarantee due to the limitations of their chemical composition full adhesion in an environment that is subject to extreme conditions.

There have been attempts to solve this problem by providing, successively:

stoppers whose bond between the stopper head and body is enhanced by a solid cylindrical element that protrudes and enters into a blind hole in the stopper body, stoppers without glue, whose bond between the stopper head and stopper body is formed by overmolding.

However, it is often observed that the stopper body separates from the head when opening a bottle fitted with such a stopper because of adhesion problems between these elements.

During use, this assembly is effectively subject to tensile mechanical stress, which could result in tearing the stopper head.

The strength of the bond, or attachment, between the stopper body and the stopper head must therefore be increased.

SUMMARY OF THE INVENTION

This invention aims to overcome these drawbacks by providing a stopper head that is simple in its design and operation and economical, providing a better attachment between the stopper head and the stopper body.

As such, the invention relates to a stopper head to be secured to a stopper body to form a stopper for a container.

According to the invention, this head comprises a base on which a lug is positioned such that it protrudes, said lug being designed to cooperate with said body during the assembly of this body and this lug. This lug comprises at least one recess opening laterally at both of its ends, such that said lug is crossed through to anchor said body with said head.

Purely as an example, this head can be made of metal, wood, or even plastic.

The stopper head can be one piece or the result of mounting a lug onto a base. For example, this mounting can be achieve by welding.

By "one piece", it is meant that this clip is made from one part, not as a result of assembling originally separate parts.

In various particular embodiments of this stopper head, each having its particular advantages and open to many possible technical combinations:

Because the lug has an elongated shape, said recess has a flared shape in the longitudinal direction of the lug, the widest part of the recess being positioned on the side of the free end of said lug, This free end is defined opposite the other end of the lug, which is secured to the base of the stopper head.

This flared shape of the recess advantageously improves the flow of the plastic during the overmolding of the stopper body around the lug. Also, it provides additional material support in the area where the body and lug are molded together, which is the most heavily prone to tearing.

This flared shape of the recess represents balance between improving the attachment of the stopper body to the stopper head and weakening the lug.

Said lug has rotational asymmetry to prevent said body from rotating around said lug, The lug therefore does not have a rotational symmetry. It can have an elliptical, egg-shaped, or potato-shaped cross-section, for example.

Alternatively, the lug may comprise at least one edge to block the rotation of said body. In this latter case, the lug may have a polygonal cross-section, such as a square, rhombus, etc.

This head comprises at least one element to mechanically stiffen the lug, this mechanically stiffening element being secured to said base and to said lug.

Preferably, it is a stiffening rib.

Advantageously, said at least one stiffening element has a shape designed to cooperate with said body in order to block its rotation.

This shape can be a stiffening rib having a flat portion arranged such that it blocks the movement of the stopper body.

Said base comprises on its receiving face said lug, attachment elements projecting from said base and/or a groove to strengthen the adhesion of said body with said head.

These attachment elements, with longitudinal dimensions that are less than those of the lug, form a relief that engages into the stopper body during the overmolding, thereby strengthening the adhesion of the stopper body and the stopper head.

The base may have on its receiving face the lug or a continuous or non-continuous groove, designed to accommodate part of the stopper body during the assembly of this body with the stopper head so that this stopper body is secured not only to the lug, but also to the base. The attachment of the stopper body and the stopper head is thus strengthened. This groove may, for example, be in the shape of a continuous or non-continuous circular recess, surrounding the lug.

Said lug is rough to strengthen the adhesion of said stopper body with said head.

The invention further relates to a stopper for a container, consisting of two different materials and comprising a stopper head secured to a body, obtained from a material or combination of moldable materials.

According to the invention, this stopper head is a head as described above.

The stopper body can thus be achieved, for example, from food grade plastic or from resin. This stopper body can also be loaded with particles of cork.

This stopper is intended especially for the food industry. Preferably, for spirits or wine, this stopper comprises a means of security to authenticate the origin of the product. For example, this can be a barcode or a chip comprising particles capable of emitting a response to a light stimulus. These particles are, for example, phosphorescent particles that respond to a light stimulus such as ultraviolet (UV). These particles may be arranged on the chip in such a way that they form the symbol, such as a brand, that identifies or personalizes the contents of the container.

The invention further relates to a container, such as a bottle, sealed by a stopper as described above.

BRIEF DESCRIPTION OF THE DRAWING FIGURES

In its various possible embodiments of this stopper head, the invention will be described in more detail with reference to the accompanying drawings, in which.

DETAILED DESCRIPTION OF THE INVENTION

Figure 1:
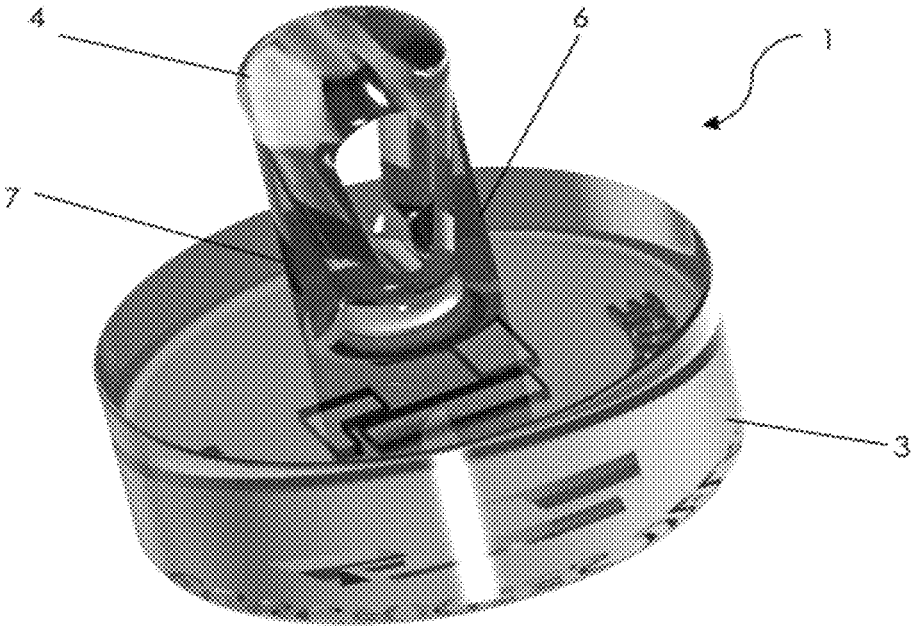
FIG. 1 shows a perspective view of a stopper head according to a preferred embodiment of the invention.
Figure 2:
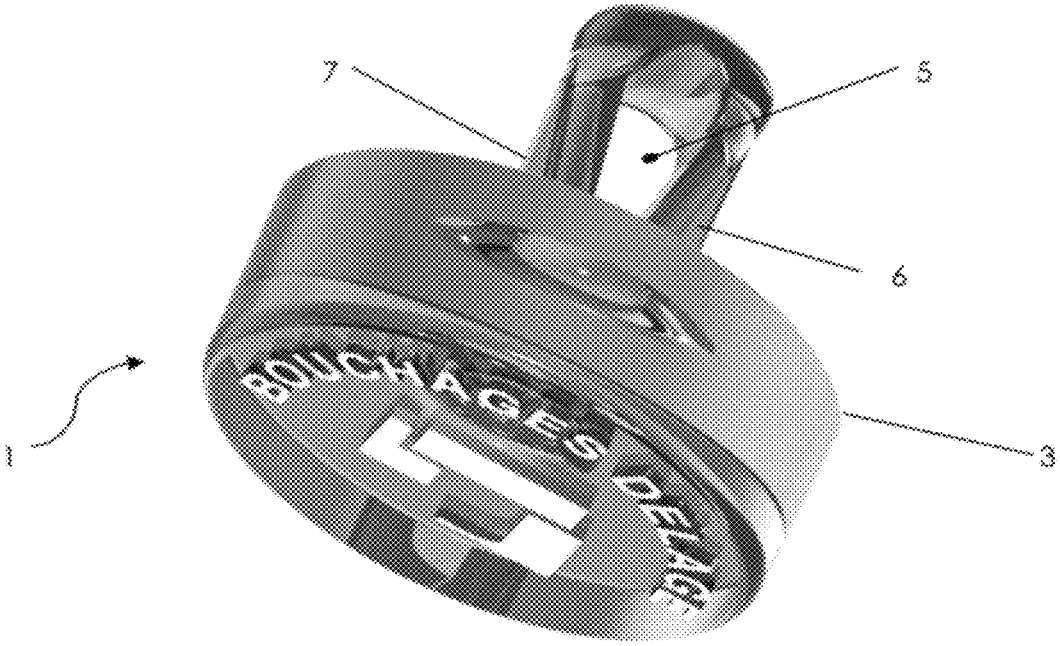
FIG. 2 shows another perspective view of the stopper head in FIG. 1.

FIGS. 1 and 2 show a stopper head according to a preferred embodiment of the invention. This stopper head 1, which is one piece, is made here from plastic.

Figure 3:
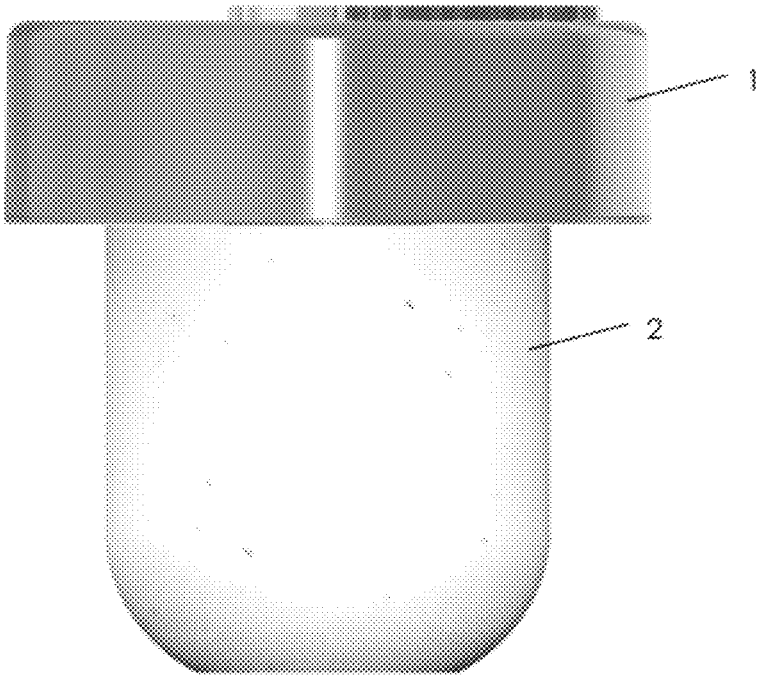
FIG. 3 shows a profile view of a stopper for a container obtained from the stopper head in FIG. 1.

This stopper head 1 is intended to be secured to a stopper body 2 to form a stopper for a container as shown in FIG. 3.

This head 1 comprises a base 3, forming a capsule, and a lug 4 protruding from this base 3. This lug 4, which is longitudinal, is designed to cooperate with the stopper body 2 during its overmolding around the lug.

The lug 4 comprises a single opening 5 that opens laterally through the lug such that the plastic can cross through the lug 4 during the overmolding of the stopper body 2 around it.

In addition, this opening 5 is clearly cone-shaped in the longitudinal direction of the lug 5, its base positioned on the side of the free end of the lug. Additional material support will therefore be present at this base, which is the part of the lug 4 that is the most highly stressed when removing the stopper from a bottle.

In addition, this stopper head 1 comprises stiffening ribs 6, 7 that are secured to the base 3 and to the lug 4. These ribs 6, 7, which are positioned on either side of the lug 4, are here straight ribs to block the rotation of the stopper body 2.

The stopper body 2 is advantageously made from a thermoplastic elastomer that is intended for food grade applications. Advantageously, this elastomer is loaded with particles of cork.

The invention claimed is:

1. A stopper head intended to be fastened to a stopper body to form a stopper for a container, comprising:

a base;

a tenon projecting from the base, said tenon being configured to cooperate with said body when assembling said body and said tenon; and at least one opening in said tenon, the opening discharging laterally at both ends in such a manner as to pass completely through said tenon to ensure anchoring of said body with said head, wherein said tenon has an elongate shape defining a longitudinal direction, said opening has a shape flared in said longitudinal direction, said opening being cone-shaped in said longitudinal direction, a base of the opening adjoining a free end of said tenon.

2. The head according to claim 1, wherein to prevent said body of the head rotating about said tenon, said tenon has a shape that does not have symmetry of revolution.

3. The head according to claim 2, wherein said head comprises at least one member for mechanically reinforcing said tenon fastened on the one hand to said base and on the other hand to said tenon.

4. The head according to claim 2, wherein said base includes on its face receiving said tenon attachment elements projecting from said base and/or a groove for reinforcing the adhesion of said body with said head.

5. The head according to claim 1, wherein said head comprises at least one member for mechanically reinforcing said tenon fastened on the one hand to said base and on the other hand to said tenon.

6. The head according to claim 5, wherein said at least one reinforcing member has a shape intended to cooperate with said body to prevent the body from rotating.

7. The head according to claim 1, wherein said base of the head includes a face receiving tenon attachment elements projecting from said base and/or a groove for reinforcing adhesion of said body with said head.

8. A container stopper constituted of two different materials and including a stopper head (1) fastened to a body produced from a mouldable material or a combination of mouldable materials, wherein said stopper head (1) is a head according to claim 1.

9. A stopper, comprising:

a stopper body;

a head attached to the stopper body;

a base of the head;

a tenon projecting from the base, said tenon cooperating with said stopper body; and at least one opening in said tenon, the opening discharging laterally at both ends in such a manner as to pass completely through said tenon to ensure anchoring of said stopper body with said head, wherein said tenon has an elongate shape defining a longitudinal direction, said opening has a shape flared in said longitudinal direction, said opening being cone-shaped in said longitudinal direction, a base of the opening adjoining a free end of said tenon.

10. The stopper according to claim 9, wherein to prevent said stopper body rotating about said tenon, said tenon has a shape that does not have symmetry of revolution.

11. The stopper according to claim 9, wherein said head comprises at least one member for mechanically reinforcing said tenon fastened on the one hand to said base of the head and on the other hand to said tenon.

12. The stopper according to claim 11, wherein said at least one reinforcing member has a shape intended to cooperate with said body to prevent it from rotating.

13. The stopper according to claim 9, wherein said base of the head includes a face receiving tenon attachment elements projecting from said base and/or a groove for reinforcing adhesion of said body with said head.

14. The stopper according to claim 9, wherein said stopper body is formed from thermoplastic elastomer.

15. The stopper according to claim 14, wherein said thermoplastic elastomer is loaded with particles of cork.

16. The stopper according to claim 9, further comprising a security device.

17. The stopper according to claim 16, wherein the security device is a barcode.

18. The stopper according to claim 16, wherein the security device is a chip comprising particles capable of emitting a response to a light stimulus or ultraviolet light.

19. The stopper according to claim 18, wherein the particles are arranged to form a symbol that identifies of personalizes contents of a container.

* * * * *